US012668335B2

(12) United States Patent
Kusiak

(10) Patent No.: US 12,668,335 B2
(45) Date of Patent: Jun. 30, 2026

(54) CLOSED LOOP HYDRAULIC SYSTEM FOR STABILIZING A MARINE VESSEL

(71) Applicant: Kevin M. Kusiak, Ft. Lauderdale, FL (US)

(72) Inventor: Kevin M. Kusiak, Ft. Lauderdale, FL (US)

( * ) Notice: Subject to any disclaimer, the term of this patent is extended or adjusted under 35 U.S.C. 154(b) by 314 days.

(21) Appl. No.: 18/628,101

(22) Filed: Apr. 5, 2024

(65) Prior Publication Data

US 2025/0313311 A1 Oct. 9, 2025

(51) Int. Cl.
*B63B 39/06* (2006.01)

(52) U.S. Cl.
CPC ..... *B63B 39/06* (2013.01)

(58) Field of Classification Search
CPC ..... B63B 39/06
See application file for complete search history.

(56) References Cited

U.S. PATENT DOCUMENTS 7,263,942 B1 * 9/2007 Dobashi et al. ..... B63B 39/06 114/122

FOREIGN PATENT DOCUMENTS

CN 120229341 A * 7/2025 ..... B63B 39/06
WO WO-2016068121 A1 * 5/2016 ..... B60F 3/0038

* cited by examiner

*Primary Examiner* — Timothy D Collins
(74) *Attorney, Agent, or Firm* — The Rapacke Law Group, P.A.

(57) ABSTRACT

A closed loop hydraulic system for stabilizing a marine vessel can include a hydraulic pump including a first port and a second port; a pump actuator operably coupled to the hydraulic pump; a first hydraulic cylinder and a second hydraulic cylinder rotatably connected to a crank; a shaft in rotational communication with the crank; a stabilizing fin mounted to a hull of the marine vessel, the stabilizing fin in rotational communication with the shaft and the crank; wherein: the first hydraulic cylinder rotates the crank and the shaft in response to a first pressure difference between a first chamber portion and a second chamber portion of the first hydraulic cylinder, thereby rotating a stabilizing fin; the second hydraulic cylinder rotates the crank and the shaft in response to a second pressure difference between a third chamber portion and a fourth chamber portion, thereby rotating the stabilizing fin.

20 Claims, 7 Drawing Sheets

CLOSED LOOP HYDRAULIC SYSTEM FOR STABILIZING A MARINE VESSEL

TECHNICAL FIELD

The embodiments generally relate to the field of systems for stabilizing marine vessels.

BACKGROUND

Generally, marine vessel stabilizers such as stabilizing fins are not actuated using closed loop hydraulics.

There is a need for a system that actuates a stabilizing fin using closed loop hydraulics, and which recovers energy through the stabilizing fin's interaction with the surrounding water flow.

SUMMARY

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

In general, the disclosed closed loop hydraulic system for stabilizing a marine vessel can include a hydraulic pump including at least a first port and a second port; a pump actuator operably coupled to the hydraulic pump; a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion; a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion; a shaft; a first crank in rotational communication with the shaft; a stabilizing fin that is constructed and arranged to be mounted to a hull of the marine vessel, the stabilizing fin in rotational communication with the shaft and the first crank; wherein: the first port of the hydraulic pump is in hydraulic communication with at least the first chamber portion of the first hydraulic cylinder and the fourth chamber portion of the second hydraulic cylinder; the second port of the hydraulic pump is in hydraulic communication with at least the second chamber portion of the first hydraulic cylinder and the third chamber portion of the second hydraulic cylinder; the first rod is rotatably connected to a first portion of the first crank; the second rod is rotatably connected to a second portion of the first crank; the first piston is constructed and arranged to move the first rod in response to a first pressure difference between the first chamber portion and the second chamber portion; the first rod is constructed and arranged to rotate the stabilizing fin in a first direction and in a second direction opposite the first direction by rotating the first crank and the shaft; the second piston is constructed and arranged to move the second rod in response to a second pressure difference between the third chamber portion and the fourth chamber portion; and the second rod is constructed and arranged to rotate the stabilizing fin in the first direction and in the second direction opposite the first direction by rotating the first crank and the shaft.

Other illustrative variations within the scope of the invention will become apparent from the detailed description provided hereinafter. The detailed description and enumerated variations, while disclosing optional variations, are intended for purposes of illustration only and are not intended to limit the scope of the invention.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

Figure 1:
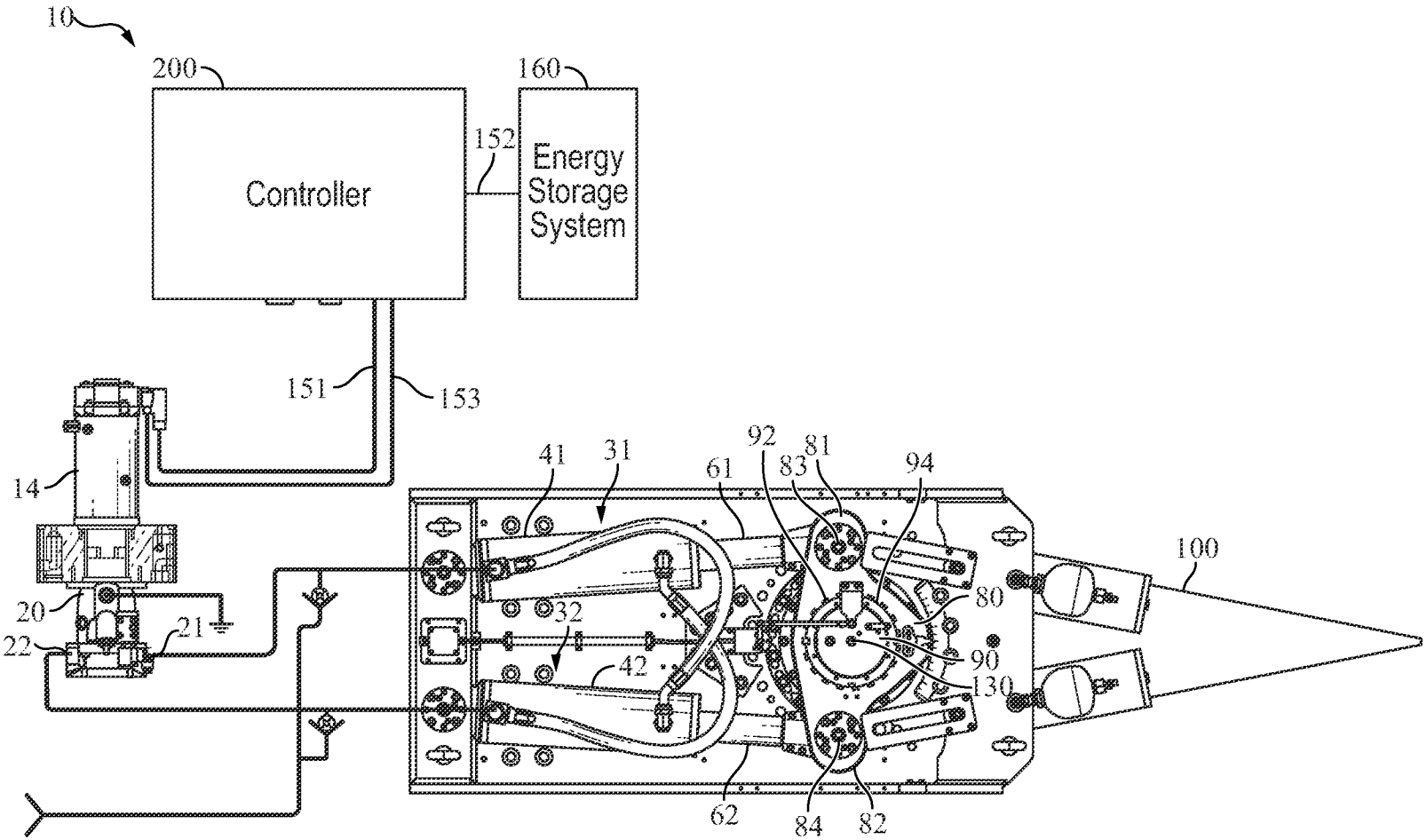
FIG. 1 illustrates a closed loop hydraulic system for stabilizing a marine vessel, according to some embodiments disclosed herein.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described product or methods of use. Any specific details of the embodiments are used for demonstration purposes only and no unnecessary limitations or inferences are to be understood from there.

It is noted that the embodiments reside primarily in combinations of components and procedures related to the products. Accordingly, the product and components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a closed loop hydraulic system for stabilizing a marine vessel. In some embodiments, the system can include a pump actuator operably coupled to a hydraulic pump. The pump actuator can be any actuator constructed and arranged to actuate the hydraulic pump. For example, the pump actuator can include an electric motor such as, for example, a servo motor.

The system can include a controller for controlling the pump actuator and a energy storage system electrically connected to the controller and the pump actuator. The energy storage system can be constructed and arranged to provide power to the pump actuator and the controller.

The system can include a hydraulic pump having at least a first port and a second port. The hydraulic pump can be a reversible 4-quadrant pump constructed for 4-quadrant operation. For example, the hydraulic pump, while operating as a motor, can be constructed and arranged to receive a relatively higher pressure fluid at the first port and return a relatively lower pressure fluid at the second port, wherein at least a portion of the hydraulic energy at the first port is converted to mechanical energy by the hydraulic pump to actuate a pump shaft of the hydraulic pump which can be used to actuate a shaft of an electric motor to generate electricity. As another example, the hydraulic pump, while operating as a motor, can be constructed and arranged to receive a relatively higher pressure fluid at the second port and return a relatively lower pressure fluid at the first port, wherein at least a portion of the hydraulic energy at the second port is converted to mechanical energy by the hydraulic pump to actuate the pump shaft of the hydraulic pump which can be used to actuate a shaft of an electric motor to generate electricity. As another example, the hydraulic pump, while operating as a pump and being actuated by the pump actuator, can be constructed and arranged to receive a relatively lower pressure fluid at the second port and provide a relatively higher pressure fluid at the first port. As another example, the hydraulic pump, while operating as a pump and being actuated by the pump actuator, can be constructed and arranged to receive a relatively lower pressure fluid at the first port and provide a relatively higher pressure fluid at the second port.

In some embodiments, the system can include a first hydraulic cylinder and a second hydraulic cylinder in hydraulic communication with the hydraulic pump. In some embodiments, the first hydraulic cylinder and the second hydraulic cylinder are actuated by the hydraulic pump to rotate a first crank that is in rotational communication with a marine stabilizer.

In some embodiments, the marine stabilizer is constructed and arranged to be mounted to a hull of any marine vessel such as, for example, a ship, a submarine, a yacht, etc. In some embodiments, the marine vessel can be a powered marine vessel (e.g., powered by a combustion engine). In some embodiments, the marine stabilizer can include a stabilizing fin. When a marine vessel begins to roll, the stabilizing fin can be rotated to generate lift as the fin interacts with water flow surrounding the fin, thereby reducing the marine vessel's roll motion which stabilizes the marine vessel.

Referring to FIG. 1, a system 10 for stabilizing a marine vessel (e.g., 18 in FIGS. 4-6) can include at least one hydraulic pump 20 that includes at least a first port 21 and a second port 22. In some embodiments, the system 10 can include at least one pump actuator 14 operably coupled to the hydraulic pump 20. In some embodiments, the pump actuator 14 can be constructed and arranged to drive the hydraulic pump 20. In some embodiments, the pump actuator 14 can be an electric motor such as, for example, a servo motor 14.

Figure 2:
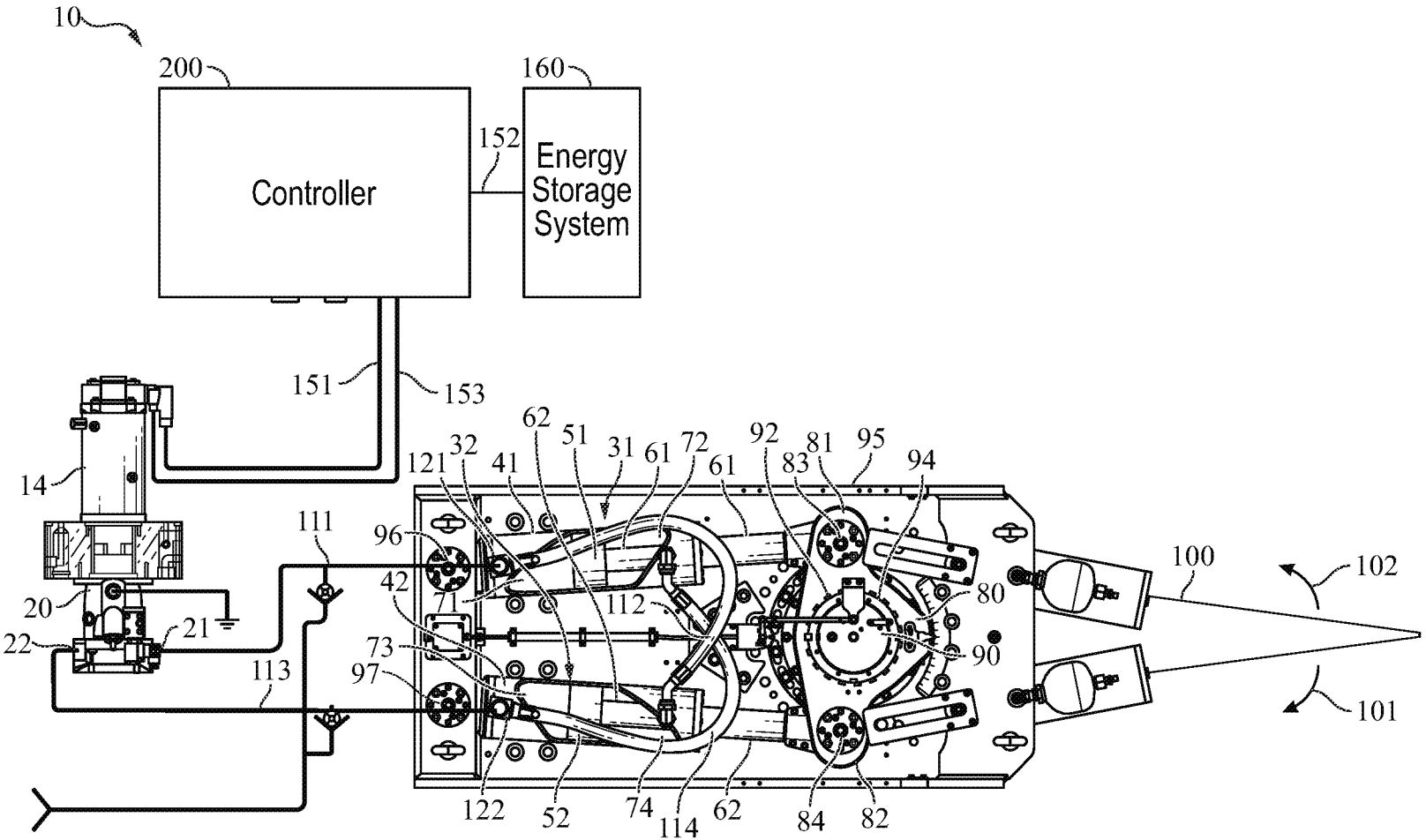
FIG. 2 illustrates a closed loop hydraulic system for stabilizing a marine vessel, with interiors of hydraulic cylinders shown, according to some embodiments disclosed herein.

In some embodiments, the system 10 can include a first hydraulic cylinder 31 and a second hydraulic cylinder 32. Referring to FIG. 2, in some embodiments, the first hydraulic cylinder 31 can include a first body 41, a first piston 51 positioned within the first body 41, and a first rod 61 connected to the first piston 51. In some embodiments, the first hydraulic cylinder 31 can include a first chamber portion 71 within the first body 41, and a second chamber portion 72 within the first body 41, wherein the first piston 51 is positioned between the first chamber portion 71 and the second chamber portion 72. In some embodiments, the first hydraulic cylinder 31 can be a double acting hydraulic cylinder 31.

In some embodiments, the second hydraulic cylinder 32 can include a second body 42, a second piston 52 positioned within the second body 42, and a second rod 62 connected to the second piston 52. In some embodiments, the second hydraulic cylinder 32 can include a third chamber portion 73 within the second body 42, and a fourth chamber portion 74 within the second body 42, wherein the second piston 52 is positioned between the third chamber portion 73 and the fourth chamber portion 74. In some embodiments, the second hydraulic cylinder 32 can be a double acting hydraulic cylinder 32.

In some embodiments, the first rod 61 can be rotatably connected to a first portion 81 of a first crank 80. In some embodiments, the first rod 61 can be rotatably connected to the first portion 81 of the first crank 80 by at least a first pivot 83 connected to (e.g., mounted to) the first portion 81 of the first crank 80. In some embodiments, the first rod 61 can rotate about the first pivot 83. In some embodiments, the first pivot 83 can be a pivot shaft, pivot rod, pivot pin, etc.

In some embodiments, the second rod 62 can be rotatably connected to a second portion 82 of the first crank 80. In some embodiments, the second rod 62 can be rotatably connected to the second portion 82 of the first crank 80 by at least a second pivot 84 connected to (e.g., mounted to) the second portion 82 of the first crank 80. In some embodiments, the second rod 62 can rotate about the second pivot 84. In some embodiments, the second pivot 84 can be a pivot shaft, pivot rod, pivot pin, etc.

In some embodiments, the system 10 can include a shaft 90, and the first crank 80 can be in rotational communication with the shaft 90 so that the first crank 80 rotates with the shaft 90. For example, the first crank 80 can be in rotational communication with the shaft 90 by being mounted on the shaft 90 so that the shaft 90 is rotating when the first crank 80 is rotating, and the shaft 90 is not rotating when the first crank 80 is not rotating. In some embodiments, the first crank 80 can be mounted on the shaft 90 via a bolted connection, a welded connection, a riveted connection or a splined connection, any other suitable durable connection(s), or any combination thereof. As another example, the first crank 80 can be in rotational communication with the shaft 90 via a splined shaft, with bolts used to compress the splines of the crank 80 around the shaft 90. One or more first teeth 92 of the splined shaft 90 can be engaged with one or more second teeth of the splined crank 80. As another example, the first crank 80 can be in rotational communication with the shaft 90 when one or more gears (not shown) are in rotational communication with the shaft 90 and the first crank 80. The one or more gears can be constructed and arranged to transfer any rotational motion between the shaft 90 and the first crank 80.

In some embodiments, the system 10 can include a frame 95. In some embodiments, the first body 41 of the first hydraulic cylinder 31 can be rotatably connected to the frame 95 at a third pivot 96. In some embodiments, the second body 42 of the second hydraulic cylinder 32 can be rotatably connected to the frame 95 at a fourth pivot 97. In some embodiments, the third pivot 96 and the fourth pivot 97 can be pivot shafts, pivot rods, pivot pins, etc. In some embodiments, the first crank 80 can be rotatably connected to the frame 95 so that the first crank 80 rotates on the frame 95.

In some embodiments, the system 10 can include a stabilizing fin 100 that is in rotational communication with the shaft 90 and the first crank 80 so that the stabilizing fin 100 rotates with the shaft 90 and the first crank 80. For example, the stabilizing fin 100 can be in rotational communication with the shaft 90 by being mounted on the shaft 90 so that the stabilizing fin 100 is rotating when the shaft 90 is rotating, and the stabilizing fin 100 is not rotating when the shaft 90 is not rotating. In some embodiments, the stabilizing fin 100 can be mounted on the shaft 90 via a bolted connection, a welded connection, a riveted connection, a splined connection or any other suitable durable connection(s), or any combination thereof.

In some embodiments, the system 10 can be a substantially closed loop hydraulic system 10. For example, to actuate the stabilizing fin 100, the first port 21 of the hydraulic pump 20 can be in hydraulic communication with at least the first chamber portion 71 of the first hydraulic cylinder 31 and the fourth chamber portion 74 of the second hydraulic cylinder 32. For example, in some embodiments, the first port 21 of the hydraulic pump 20 can be hydraulically connected to the first chamber portion 71 of the first hydraulic cylinder 31 by at least a first hydraulic connection 111. As another example, the first port 21 of the hydraulic pump 20 can be hydraulically connected to the fourth chamber portion 74 of the second hydraulic cylinder 32 by at least the first hydraulic connection 111, a first hydraulic coupler 121, and a second hydraulic connection 112.

In some embodiments, the first hydraulic coupler 121 can be connected to the first body 41 of the first hydraulic cylinder 31, the first hydraulic connection 111, and the second hydraulic connection 112 to hydraulically connect the first port 21 of the hydraulic pump 20 to the first chamber portion 71 of the first hydraulic cylinder 31 and the fourth chamber portion 74 of the second hydraulic cylinder 32. In some embodiments, the first port 21 of the hydraulic pump 20 can be in hydraulic fluid communication with at least the first chamber portion 71 of the first hydraulic cylinder 31 and the fourth chamber portion 74 of the second hydraulic cylinder 32 using any suitable hydraulic fluid such as, for example, hydraulic oil. In some embodiments, the first port 21 of the hydraulic pump 20, the first chamber portion 71 of the first hydraulic cylinder 31, and the fourth chamber portion 74 of the second hydraulic cylinder 32 can be constructed and arranged to have a same pressure.

In some embodiments, the first hydraulic connection 111 can include a hydraulic line, a hydraulic hose, a hydraulic pipe, any other hydraulic connection, or any combination thereof. In some embodiments, the hydraulic connection 111 can be in fluid communication with a check valve and a hydraulic fluid source. In some embodiments, the second hydraulic connection 112 can include a hydraulic line, a hydraulic hose, a hydraulic pipe, any other hydraulic connection, or any combination thereof. In some embodiments, the first hydraulic coupler 121 can include a hydraulic junction block, a hydraulic manifold, a hydraulic multiplier, any other hydraulic coupler, or any combination thereof.

In some embodiments, the second port 22 of the hydraulic pump 20 can be in hydraulic communication with at least the third chamber portion 73 of the second hydraulic cylinder 32 and the second chamber portion 72 of the first hydraulic cylinder 31. For example, in some embodiments, the second port 22 of the hydraulic pump 20 can be hydraulically connected to the third chamber portion 73 of the second hydraulic cylinder 32 by at least a third hydraulic connection 113. As another example, the second port 22 of the hydraulic pump 20 can be hydraulically connected to the second chamber portion 72 of the first hydraulic cylinder 31 by at least the third hydraulic connection 113, a second hydraulic coupler 122, and a fourth hydraulic connection 114.

In some embodiments, the second hydraulic coupler 122 can be connected to the second body 42 of the second hydraulic cylinder 32, the third hydraulic connection 113, and the fourth hydraulic connection 114 to hydraulically connect the second port 22 of the hydraulic pump 20 to the second chamber portion 72 of the first hydraulic cylinder 31 and the third chamber portion 73 of the second hydraulic cylinder 32. In some embodiments, the second port 22 of the hydraulic pump 20 can be in hydraulic fluid communication with at least the second chamber portion 72 of the first hydraulic cylinder 31 and the third chamber portion 73 of the second hydraulic cylinder 32 using any suitable hydraulic fluid such as, for example, hydraulic oil. In some embodiments, the second port 22 of the hydraulic pump 20, the second chamber portion 72 of the first hydraulic cylinder 31, and the third chamber portion 73 of the second hydraulic cylinder 32 can be constructed and arranged to have a same pressure.

In some embodiments, the third hydraulic connection 113 can include a hydraulic line, a hydraulic hose, a hydraulic pipe, any other hydraulic connection, or any combination thereof. In some embodiments, the hydraulic connection 113 can be in fluid communication with a check valve and a hydraulic fluid source. In some embodiments, the fourth hydraulic connection 114 can include a hydraulic line, a hydraulic hose, a hydraulic pipe, any other hydraulic connection, or any combination thereof. In some embodiments, the second hydraulic coupler 122 can include a hydraulic junction block, a hydraulic manifold, a hydraulic multiplier, any other hydraulic coupler, or any combination thereof.

In some embodiments, the first piston 51 can be constructed and arranged to move the first rod 61 in response to a first pressure difference between the first chamber portion 71 and the second chamber portion 72. In some embodiments, the first rod 61 can be constructed and arranged to rotate the stabilizing fin 100 in a first direction 101 and in a second direction 102 opposite the first direction 101 by rotating the first crank 80 and the shaft 90. The first direction 101 and the second direction 102 can be rotational directions about a rotational axis parallel to the shaft 90.

In some embodiments, the second piston 52 can be constructed and arranged to move the second rod 62 in response to a second pressure difference between the third chamber portion 73 and the fourth chamber portion 74. In some embodiments, the second rod 62 can be constructed and arranged to rotate the stabilizing fin 100 in the first direction 101 and in the second direction 102 opposite the first direction 101 by rotating the first crank 80 and the shaft 90.

In some embodiments, the first pressure difference and the second pressure difference can be created by using the pump actuator 14 to drive the hydraulic pump 20 to increase pressure at the first port 21, decrease pressure at the first port 21, increase pressure at the second port 22, decrease pressure at the second port 22, or any combination thereof.

Figure 3A:
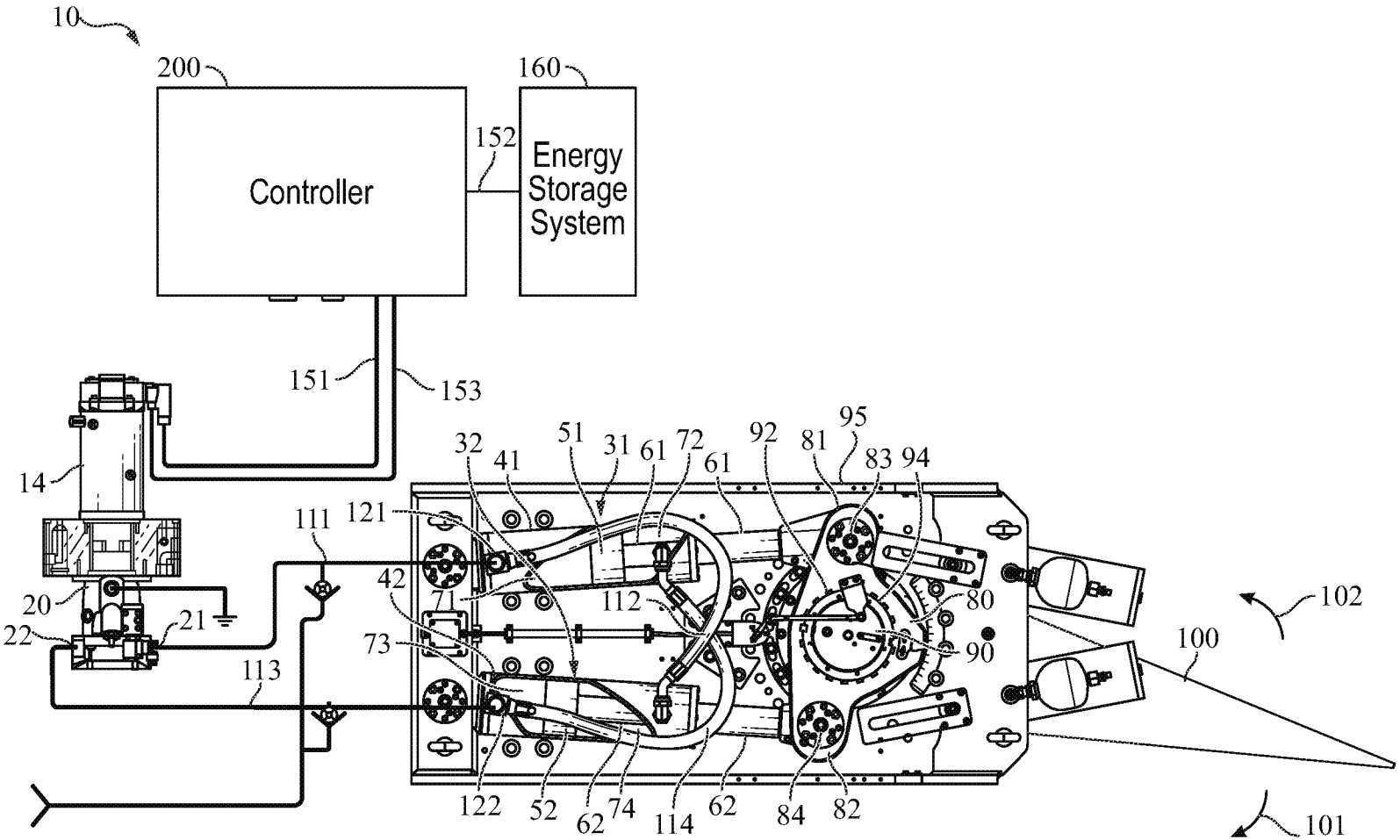
FIG. 3A illustrates a closed loop hydraulic system for stabilizing a marine vessel with a stabilizing fin rotated in a first direction, according to some embodiments disclosed herein.

In some embodiments, the hydraulic pump 20 can be driven to increase pressure at the first port 21, which increases pressure in the first chamber portion 71 and increases pressure in the fourth chamber portion 74. For example, referring to FIG. 3A, the increased pressure in the first chamber portion 71 can cause the first piston 51 and the first rod 61 to move to rotate the crank 80 in the first direction 101 (e.g., the clockwise direction), thereby causing the shaft 90 and the stabilizing fin to rotate in the first direction 101. While the first piston 51 and the first rod 61 move to rotate the crank 80 in the first direction 101, the increased pressure in the fourth chamber portion 74 can cause the second piston 52 and the second rod 62 to move to rotate the crank 80 in the first direction 101, thereby causing the shaft 90 and the stabilizing fin to rotate in the first direction 101. As two pistons 51, 52 and two rods 61, 62 are connected to the crank 80, the linear momentum transferred to the first crank 80 is reduced or minimized compared to if only a single piston and single rod were connected to the first crank 80.

Figure 3B:
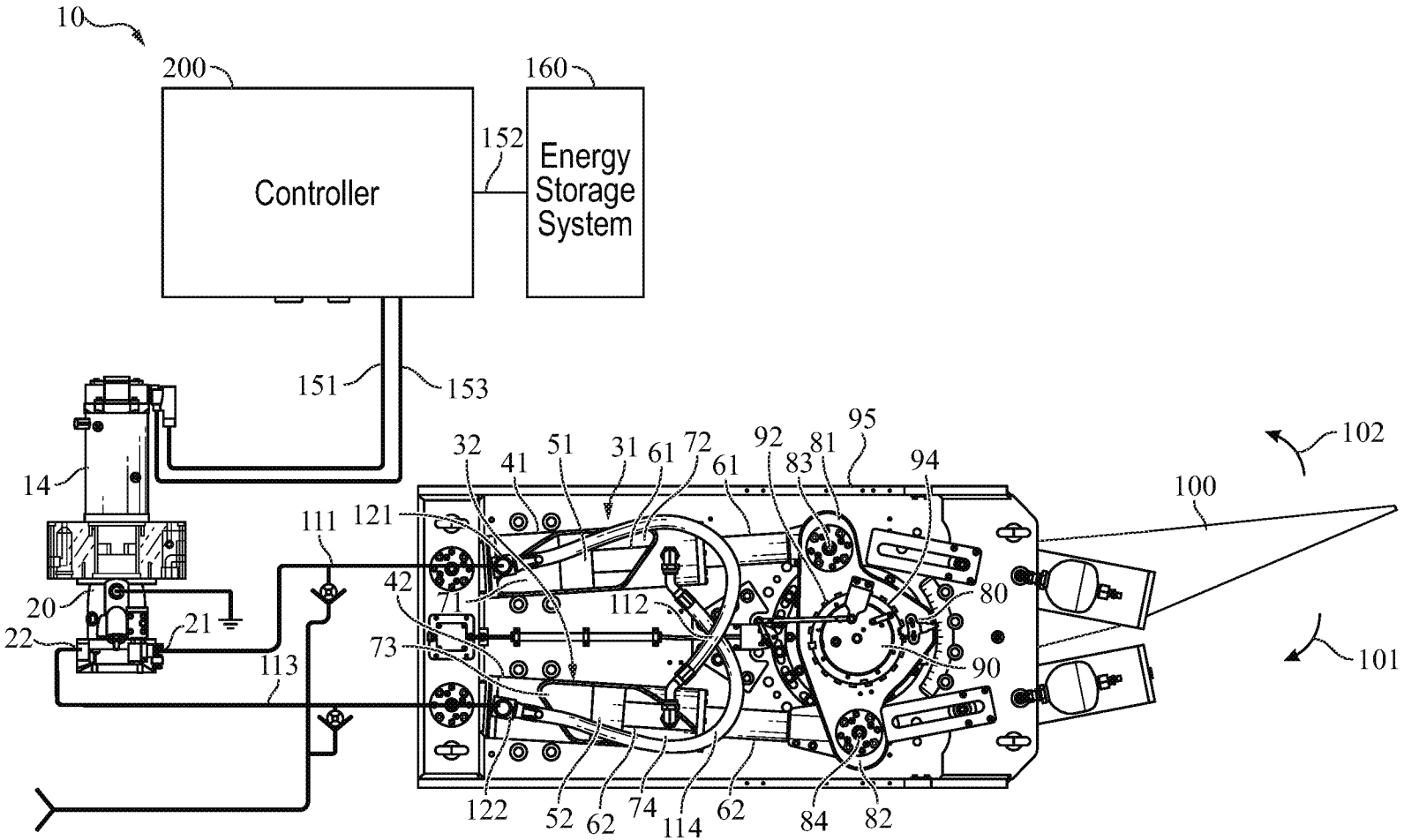
FIG. 3B illustrates a closed loop hydraulic system for stabilizing a marine vessel with a stabilizing fin rotated in a second direction, according to some embodiments disclosed herein.

In some embodiments, the hydraulic pump 20 can be driven to increase pressure at the second port 22, which increases pressure in the second chamber portion 72 and increases pressure in the third chamber portion 73. For example, referring to FIG. 3B, the increased pressure in the second chamber portion 72 can cause the first piston 51 and the first rod 61 to move to rotate the crank 80 in the second direction 102 (e.g., the counterclockwise direction), thereby causing the shaft 90 and the stabilizing fin to rotate in the second direction 102. While the first piston 51 and the first rod 61 move to rotate the crank 80 in the second direction 102, the increased pressure in the third chamber portion 73 can cause the second piston 52 and the second rod 62 to move to rotate the crank 80 in the second direction 102, thereby causing the shaft 90 and the stabilizing fin to rotate in the second direction 102.

Figure 4:
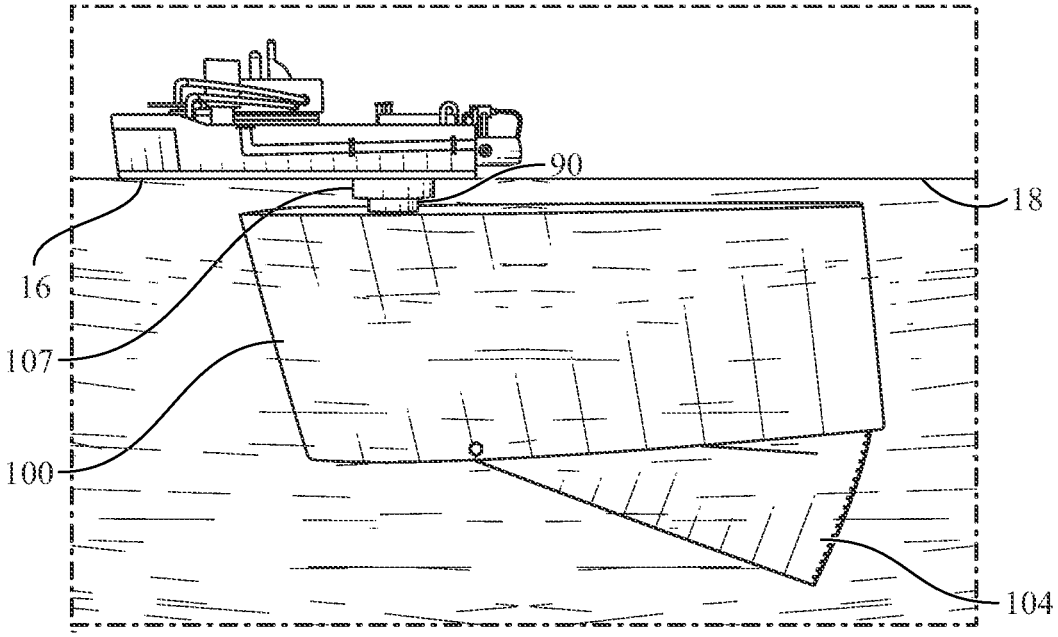
FIG. 4 illustrates a closed loop hydraulic system for stabilizing a marine vessel, the system being mounted to a hull of the marine vessel, according to some embodiments disclosed herein.

Referring to FIG. 4, in some embodiments, the stabilizing fin 100 can be constructed and arranged to be mounted to a hull 16 of a marine vessel 18. In some embodiments, the marine vessel 18 can be any marine vessel such as, for example, a ship, a submarine, a yacht, etc. In some embodiments, one or more seals 107 can be positioned on the hull 16 and around the shaft 90. In some embodiments, the one or more seals 107 can be constructed and arranged to prevent at least water and debris from entering the hull 16 while allowing the shaft 90 to rotate. For example, the one or more seals 107 can include a rotary shaft seal, a polyurethane seal, an elastomeric seal, a gasket, any other suitable seal, or any combination thereof. In some embodiments, the stabilizing fin 100 can include a retractable portion 104 that is constructed and arranged to retract and expand.

Figure 5:
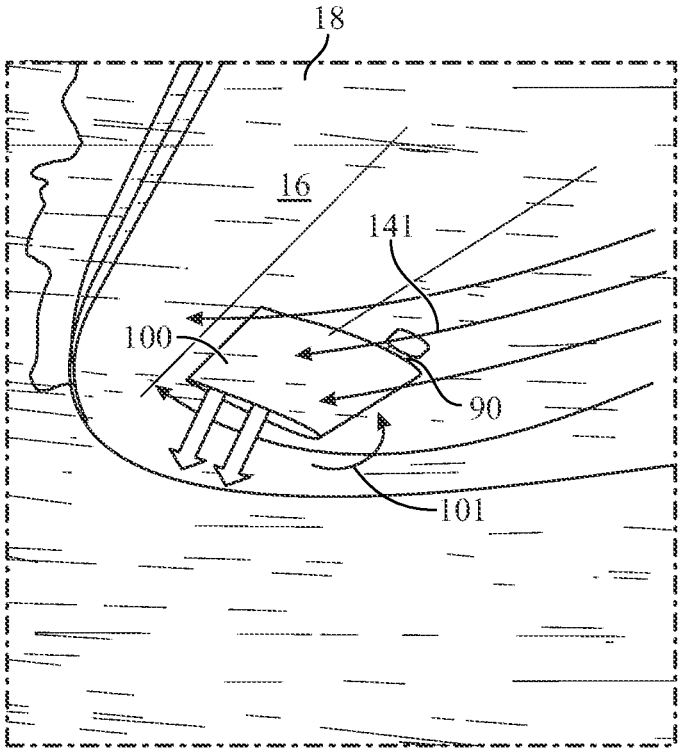
FIG. 5 illustrates a closed loop hydraulic system for stabilizing a marine vessel, the system being mounted to a hull of the marine vessel, with a water flow rotating the stabilizing fin in a first direction, according to some embodiments disclosed herein.

Referring to FIG. 5, in some embodiments, rotation of the stabilizing fin 100 in the first direction 101 rotates the shaft 90 in the first direction 101, and rotation of the shaft 90 rotates the first crank (e.g., 80 in FIGS. 1, 2, 3A and 3B) in the first direction 101. For example, a water flow 141 can push on the stabilizing fin 100 to rotate in the first direction 101. In some embodiments, the water flow 141 can push on the stabilizing fin 100 to rotate in the first direction 101 while the stabilizing fin 100 is actuated by the hydraulic pump 20 to rotate in the first direction 101, thereby causing the stabilizing fin 100 to rotate in the first direction 101 at a faster rate.

Turning back to FIG. 3A, when the water flow 141 in FIG. 5 pushes on the stabilizing fin 100, the stabilizing fin 100 can rotate to move the first piston 51 toward the second chamber portion 72 of the first hydraulic cylinder 31 by rotating the shaft 90 and the first crank 80 so that the first crank moves the first rod 61 toward the second chamber portion 72, thereby increasing a first pressure at the second port 22 of the hydraulic pump 20. The stabilizing fin 100 can, while moving the first piston 51 toward the second chamber portion 72, rotate to move the second piston 52 toward the third chamber portion 73 of the second hydraulic cylinder 32 by rotating the shaft 90 and the first crank 80 so that the first crank moves the second rod 62 toward the third chamber portion 73, thereby increasing the first pressure at the second port 22 of the hydraulic pump 20. In some embodiments, the increased first pressure received at the second port 22 can actuate the hydraulic pump 20 to drive the pump actuator 14. In some embodiments, the hydraulic pump 20 can be constructed, arranged, and allowed to drive the pump actuator 14 to generate electricity in response to an increase in the first pressure at the second port 22 of the hydraulic pump 20.

Figure 6:
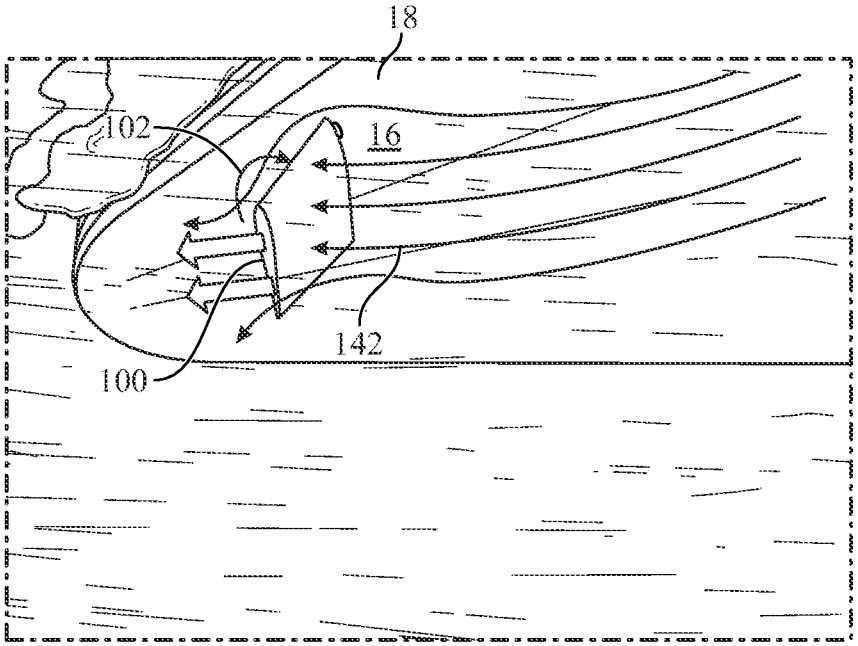
FIG. 6 illustrates a closed loop hydraulic system for stabilizing a marine vessel, the system being mounted to a hull of the marine vessel, with a water flow rotating the stabilizing fin in a second direction, according to some embodiments disclosed herein.

Referring to FIG. 6, in some embodiments, rotation of the stabilizing fin 100 in the second direction 102 rotates the shaft 90 in the second direction 102, and rotation of the shaft 90 rotates the first crank (e.g., 80 in FIGS. 1, 2, 3A and 3B) in the second direction 102. For example, a water flow 142 can push on the stabilizing fin 100 to rotate in the second direction 102. In some embodiments, the water flow 142 can push on the stabilizing fin 100 to rotate in the second direction 102 while the stabilizing fin 100 is actuated by the hydraulic pump 20 to rotate in the second direction 102, thereby causing the stabilizing fin 100 to rotate in the second direction 102 at a faster rate.

Turning back to FIG. 3B, when the water flow 142 in FIG. 6 pushes on the stabilizing fin 100, the stabilizing fin 100 can rotate to move the first piston 51 toward the first chamber portion 71 of the first hydraulic cylinder 31 by rotating the shaft 90 and the first crank 80 so that the first crank moves the first rod 61 toward the first chamber portion 71, thereby increasing a first pressure at the first port 21 of the hydraulic pump 20. The stabilizing fin 100 can, while moving the first piston 51 toward the first chamber portion 71, rotate to move the second piston 52 toward the fourth chamber portion 74 of the second hydraulic cylinder 32 by rotating the shaft 90 and the first crank 80 so that the first crank moves the second rod 62 toward the fourth chamber portion 74, thereby increasing the first pressure at the first port 21 of the hydraulic pump 20. In some embodiments, the increased first pressure received at the first port 21 can actuate the hydraulic pump 20 to drive the pump actuator 14. In some embodiments, the hydraulic pump 20 can be constructed arranged, and allowed to drive the pump actuator 14 to generate electricity in response to an increase in the first pressure at the first port 21 of the hydraulic pump 20.

In some embodiments, the pump actuator 14 can be electrically connected to a energy storage system 160. In some embodiments, any electricity generated by the pump actuator 14 can be provided to the energy storage system 160 to increase the stored energy. In some embodiments, the energy storage system 160 can be used to power the pump actuator 14 to actuate the pump actuator 14. In some embodiments, the pump actuator 14 can be electrically connected to the energy storage system 160 by at least an electrical connection 153 electrically connecting the pump actuator 14 to the controller 200, the controller 200, and an electrical connection 152 electrically connecting the controller 200 to the energy storage system 160. Power from the energy storage system 160 can be provided to the pump actuator 14 via the controller 200 and the electrical connections 152, 153. Similarly, power generated by the pump actuator 14 can be provided to the energy storage system 160 via the controller 200 and the electrical connections 152, 153.

In some embodiments, a controller 200 can be in communication (e.g., electrical communication, optical communication) with the pump actuator 14 to control the pump actuator 14 that drives the hydraulic pump 20. In some embodiments, the controller 200 can be connected to the pump actuator 14 by an electrical connection 151 that provides control signals to the hydraulic pump 20. In some embodiments, the controller 200 is electrically connected to the energy storage system 160 by at least the electrical connection 152.

Figure 7:
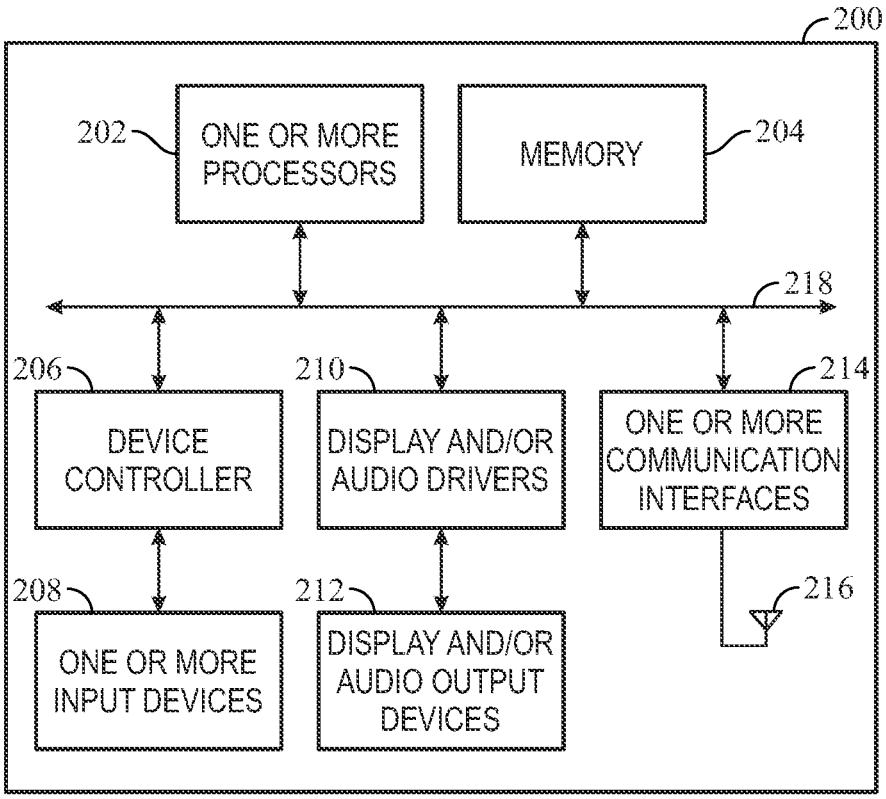
FIG. 7 illustrates a block diagram of a controller for a pump actuator, according to some embodiments disclosed herein.

Referring to FIG. 7, an example hardware of a controller 200 is illustrated. In some embodiments, the controller 200 can include one or more processors 202, memory 204, a device controller 206, one or more input devices 208, display and/or audio drivers 210, display and/or audio output devices 212, one or more communication interfaces 214, one or more antennas 216, a bus 218, or any combination thereof.

In some embodiments, the one or more processors 202 can include any suitable hardware processor, such as a central processing unit (CPU), a graphics processing unit (GPU), a tensor processing unit (TPU), an accelerated processing unit (APU), any other type of processing unit, or any combination thereof. In some embodiments, the one or more processors 202 can include a microprocessor, a microcontroller, a digital signal processor, dedicated logic, an application-specific integrated circuit (ASIC), a field programmable gate array (FPGA), an accelerator (e.g., an artificial intelligence (AI) accelerator or a cryptographic accelerator), any other suitable circuitry for controlling the functioning of a pump actuator (e.g., 14 in FIGS. 1, 2, 3A and 3B), or any combination thereof.

In some embodiments, one or more processors 202 of can be controlled by a computer program stored in memory 204 of the controller 200. For example, the computer program can cause the one or more processors 202 to send one or more control signals to a pump actuator to control the driving of a hydraulic pump (e.g., 20 in FIGS. 1, 2, 3A and 3B).

In some embodiments, the memory 204 can include any suitable memory, storage, or a combination thereof for storing programs, data, and/or any other suitable information. For example, memory 204 can include volatile memory, non-volatile memory, or any combination thereof. In some embodiments, memory 204 can include random access memory, read-only memory, flash memory, a hard disk drive, a solid state drive, optical media, any other suitable memory, or any combination thereof.

In some embodiments, the device controller 206 can include any suitable processor or circuitry for controlling and receiving any input from the one or more input devices 208. In some embodiments, the one or more input devices 208 can include a touchscreen, a keyboard, a mouse, one or more buttons, a voice recognition circuit, a camera, one or more sensors, a global positioning system (GPS) receiver, any other suitable input device, or any combination thereof. In some embodiments, the one or more sensors can include one or more roll sensors, one or more accelerometers, one or more gyroscope sensors, one or more microphones, any other suitable sensors (e.g., an optical sensor, a temperature sensor, a near field sensor), or any combination thereof.

In some embodiments, the display and/or audio drivers 210 can include any suitable circuitry for controlling and driving output to one or more display and/or audio output devices 212. For example, the output devices can include a display (e.g., including a touchscreen, a flat-panel display, a cathode ray tube display, a projector, any other suitable display or presentation device, or any combination thereof), one or more speakers, or a combination thereof.

In some embodiments, the one or more communication interfaces 214 can include any suitable circuitry for interfacing with one or more communication networks, such as an Internet network. For example, the one or more communication interfaces 214 can include network interface card circuitry, wired communication circuitry, wireless communication circuitry, any other suitable communication network circuitry, or any combination thereof.

In some embodiments, the one or more antennas 216 can wirelessly communicate with a communication network. In some embodiments, the one or more antennas 216 can be omitted.

In some embodiments, the bus 218 can include any suitable communication system for communicating data, addresses, control signals, power, or any combination thereof, between two or more components 202, 204, 206, 210, and 214. In some embodiments, the bus 218 can include any suitable conductors that are constructed and arranged to communicate data, addresses, control signals, power, or any combination thereof, between two or more components 202, 204, 206, 210, and 214.

In some embodiments, any other suitable component(s) can be included in the controller 200.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, a system for stabilizing a marine vessel can include a hydraulic pump including at least a first port and a second port; a pump actuator operably coupled to the hydraulic pump; a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion; a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion; a shaft; a first crank in rotational communication with the shaft; a stabilizing fin that is constructed and arranged to be mounted to a hull of the marine vessel, the stabilizing fin being in rotational communication with the shaft and the first crank; wherein: the first port of the hydraulic pump is in hydraulic communication with at least the first chamber portion of the first hydraulic cylinder and the fourth chamber portion of the second hydraulic cylinder; the second port of the hydraulic pump is in hydraulic communication with at least the second chamber portion of the first hydraulic cylinder and the third chamber portion of the second hydraulic cylinder; the first rod is rotatably connected to a first portion of the first crank; the second rod is rotatably connected to a second portion of the first crank; the first piston is constructed and arranged to move the first rod in response to a first pressure difference between the first chamber portion and the second chamber portion; the first rod is constructed and arranged to rotate the stabilizing fin in a first direction and in a second direction opposite the first direction by rotating the first crank and the shaft; the second piston is constructed and arranged to move the second rod in response to a second pressure difference between the third chamber portion and the fourth chamber portion; and the second rod is constructed and arranged to rotate the stabilizing fin in the first direction and in the second direction opposite the first direction by rotating the first crank and the shaft.

Variation 2 can include the system of variation 1, wherein the first hydraulic cylinder and the second first hydraulic cylinder are double acting hydraulic cylinders.

Variation 3 can include the system of variation 1, wherein the hydraulic pump is a four-quadrant hydraulic pump.

Variation 4 can include the system of variation 1, wherein the pump actuator is a servo motor.

Variation 5 can include the system of variation 1, wherein rotation of the stabilizing fin rotates the shaft, and rotation of the shaft rotates the first crank.

Variation 6 can include the system of variation 1, further comprising a frame; wherein: the first body of the first hydraulic cylinder is rotatably connected to a frame; the second body of the second hydraulic cylinder is rotatably connected to the frame.

Variation 7 can include the system of variation 1, wherein: the stabilizing fin is constructed and arranged to rotate to move the first piston toward the first chamber portion of the first hydraulic cylinder by rotating the shaft and the first crank and moving the first rod, thereby increasing a first pressure at the first port of the hydraulic pump; and the stabilizing fin is constructed and arranged to, while moving the first piston toward the first chamber portion, rotate to move the second piston toward the fourth chamber portion of the second hydraulic cylinder by rotating the shaft and the first crank and moving the second rod, thereby increasing the first pressure at the first port of the hydraulic pump.

Variation 8 can include the system of variation 7, wherein the hydraulic pump is constructed arranged, and allowed to drive the pump actuator to generate electricity in response to an increase in the first pressure at the first port of the hydraulic pump.

Variation 9 can include the system of variation 1, wherein: the stabilizing fin is constructed and arranged to rotate to move the first piston toward the second chamber portion of the first hydraulic cylinder by rotating the shaft and the first crank and moving the first rod, thereby increasing a second pressure at the second port of the hydraulic pump; and the stabilizing fin is constructed and arranged to, while moving the first piston toward the second chamber portion, rotate to move the second piston toward the third chamber portion of the second hydraulic cylinder by rotating the shaft and the first crank and moving the second rod, thereby increasing the second pressure at the second port of the hydraulic pump.

Variation 10 can include the system of variation 9, wherein the hydraulic pump is constructed arranged, and allowed to drive the pump actuator to generate electricity in response to an increase in the second pressure at the second port of the hydraulic pump.

According to variation 11, a system for stabilizing a marine vessel can include a hydraulic pump including at least a first port and a second port; a pump actuator operably coupled to the hydraulic pump; a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion; a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion; a shaft; a first crank in rotational communication with the shaft; a stabilizing fin mounted to a hull of the marine vessel, the stabilizing fin being in rotational communication with the shaft and the first crank; wherein: the first port of the hydraulic pump is in hydraulic communication with at least the first chamber portion of the first hydraulic cylinder and the fourth chamber portion of the second hydraulic cylinder; the second port of the hydraulic pump is in hydraulic communication with at least the second chamber portion of the first hydraulic cylinder and the third chamber portion of the second hydraulic cylinder; the first rod is rotatably connected to a first portion of the first crank; the second rod is rotatably connected to a second portion of the first crank; the first piston moves the first rod in response to a first pressure difference between the first chamber portion and the second chamber portion; the first rod is moved by the first piston to rotate the stabilizing fin in a first direction by rotating the first crank and the shaft; the second piston moves the second rod in response to a second pressure difference between the third chamber portion and the fourth chamber portion; and the second rod is moved by the second piston to rotate the stabilizing fin in the first direction by rotating the first crank and the shaft.

Variation 12 can include the system of variation 11, wherein: the stabilizing fin is rotated to move the first piston toward the first chamber portion of the first hydraulic cylinder by rotating the shaft and the first crank and moving the first rod, thereby increasing a first pressure at the first port of the hydraulic pump; and while the stabilizing fin is rotated to move the first piston toward the first chamber portion, the stabilizing fin is rotated to move the second piston toward the fourth chamber portion of the second hydraulic cylinder by rotating the shaft and the first crank and moving the second rod, thereby increasing the first pressure at the first port of the hydraulic pump.

Variation 13 can include the system of variation 12, wherein the hydraulic pump is allowed to drive the pump actuator to generate electricity in response to an increase in the first pressure at the first port of the hydraulic pump.

Variation 14 can include the system of variation 11, wherein: the stabilizing fin is rotated to move the first piston toward the second chamber portion of the first hydraulic cylinder by rotating the shaft and the first crank and moving the first rod, thereby increasing a second pressure at the second port of the hydraulic pump; and while the stabilizing fin is rotated to move the first piston toward the second chamber portion, the stabilizing fin is rotated to move the second piston toward the third chamber portion of the second hydraulic cylinder by rotating the shaft and the first crank and moving the second rod, thereby increasing the second pressure at the second port of the hydraulic pump.

Variation 15 can include the system of variation 14, wherein the hydraulic pump is allowed to drive the pump actuator to generate electricity in response to an increase in the second pressure at the second port of the hydraulic pump.

According to variation 16, a system for stabilizing a marine vessel can include a hydraulic pump including at least a first port and a second port; a pump actuator constructed and arranged to drive the hydraulic pump; a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion; a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion; a shaft; a first crank in rotational communication with the shaft; a stabilizing fin that is constructed and arranged to be mounted to a hull of the marine vessel, the stabilizing fin being in rotational communication with the shaft and the first crank; wherein: the first port of the hydraulic pump is in fluid communication with at least the first chamber portion of the first hydraulic cylinder and the fourth chamber portion of the second hydraulic cylinder; the second port of the hydraulic pump is in fluid communication with at least the second chamber portion of the first hydraulic cylinder and the third chamber portion of the second hydraulic cylinder; the first rod is rotatably connected to a first portion of the first crank; the second rod is rotatably connected to a second portion of the first crank; the first piston is constructed and arranged to move the first rod in response to a first pressure difference between the first chamber portion and the second chamber portion; the first rod is constructed and arranged to rotate the stabilizing fin in a first direction and in a second direction opposite the first direction by rotating the first crank and the shaft; the second piston is constructed and arranged to move the second rod in response to a second pressure difference between the third chamber portion and the fourth chamber portion; and the second rod is constructed and arranged to rotate the stabilizing fin in the first direction and in the second direction opposite the first direction by rotating the first crank and the shaft.

Variation 17 can include the system of variation 16, wherein: the stabilizing fin is constructed and arranged to rotate to move the first piston toward the first chamber portion of the first hydraulic cylinder by rotating the shaft and the first crank and moving the first rod, thereby increasing a first pressure at the first port of the hydraulic pump; and the stabilizing fin is constructed and arranged to, while moving the first piston toward the first chamber portion, rotate to move the second piston toward the fourth chamber portion of the second hydraulic cylinder by rotating the shaft and the first crank and moving the second rod, thereby increasing the first pressure at the first port of the hydraulic pump.

Variation 18 can include the system of variation 17, wherein the hydraulic pump is constructed arranged and allowed to drive the pump actuator to generate electricity in response to an increase in the first pressure at the first port of the hydraulic pump.

Variation 19 can include the system of variation 16, wherein: the stabilizing fin is constructed and arranged to rotate to move the first piston toward the second chamber portion of the first hydraulic cylinder by rotating the shaft and the first crank and moving the first rod, thereby increasing a second pressure at the second port of the hydraulic pump; and the stabilizing fin is constructed and arranged to, while moving the first piston toward the second chamber portion, rotate to move the second piston toward the third chamber portion of the second hydraulic cylinder by rotating the shaft and the first crank and moving the second rod, thereby increasing the second pressure at the second port of the hydraulic pump.

Variation 20 can include the system of variation 19, wherein the hydraulic pump is constructed, arranged and allowed to drive the pump actuator to generate electricity in response to an increase in the second pressure at the second port of the hydraulic pump.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations, and even initially claimed as such, it is to be expressly understood that one or more elements from a claimed combination can, in some cases, be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible considering the above teachings without departing from the following claims.

What is claimed is:

1. A system for stabilizing a marine vessel, comprising:

a hydraulic pump including at least a first port and a second port;

a pump actuator operably coupled to the hydraulic pump;

a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion;

a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion;

a shaft;

a first crank in rotational communication with the shaft;

a stabilizing fin that is constructed and arranged to be mounted to a hull of the marine vessel, the stabilizing fin being in rotational communication with the shaft and the first crank; wherein:

the first port of the hydraulic pump is in hydraulic communication with at least the first chamber portion of the first hydraulic cylinder and the fourth chamber portion of the second hydraulic cylinder;

the second port of the hydraulic pump is in hydraulic communication with at least the second chamber portion of the first hydraulic cylinder and the third chamber portion of the second hydraulic cylinder;

the first rod is rotatably connected to a first portion of the first crank;

the second rod is rotatably connected to a second portion of the first crank;

the first piston is constructed and arranged to move the first rod in response to a first pressure difference between the first chamber portion and the second chamber portion;

the first rod is constructed and arranged to rotate the stabilizing fin in a first direction and in a second direction opposite the first direction by rotating the first crank and the shaft;

the second piston is constructed and arranged to move the second rod in response to a second pressure difference between the third chamber portion and the fourth chamber portion; and the second rod is constructed and arranged to rotate the stabilizing fin in the first direction and in the second direction opposite the first direction by rotating the first crank and the shaft.

2. The system of claim 1, wherein the first hydraulic cylinder and the second first hydraulic cylinder are double acting hydraulic cylinders.

3. The system of claim 1, wherein the hydraulic pump is a four-quadrant hydraulic pump.

4. The system of claim 1, wherein the pump actuator is a servo motor.

5. The system of claim 1, wherein rotation of the stabilizing fin rotates the shaft, and rotation of the shaft rotates the first crank.

6. The system of claim 1, further comprising a frame; wherein:

the first body of the first hydraulic cylinder is rotatably connected to a frame;

the second body of the second hydraulic cylinder is rotatably connected to the frame.

7. The system of claim 1, wherein:

the stabilizing fin is constructed and arranged to rotate to move the first piston toward the first chamber portion of the first hydraulic cylinder by rotating the shaft and the first crank and moving the first rod, thereby increasing a first pressure at the first port of the hydraulic pump; and the stabilizing fin is constructed and arranged to, while moving the first piston toward the first chamber portion, rotate to move the second piston toward the fourth chamber portion of the second hydraulic cylinder by rotating the shaft and the first crank and moving the second rod, thereby increasing the first pressure at the first port of the hydraulic pump.

8. The system of claim 7, wherein the hydraulic pump is constructed, arranged and allowed to drive the pump actuator to generate electricity in response to an increase in the first pressure at the first port of the hydraulic pump.

9. The system of claim 1, wherein:

the stabilizing fin is constructed and arranged to rotate to move the first piston toward the second chamber portion of the first hydraulic cylinder by rotating the shaft and the first crank and moving the first rod, thereby increasing a second pressure at the second port of the hydraulic pump; and the stabilizing fin is constructed and arranged to, while moving the first piston toward the second chamber portion, rotate to move the second piston toward the third chamber portion of the second hydraulic cylinder by rotating the shaft and the first crank and moving the second rod, thereby increasing the second pressure at the second port of the hydraulic pump.

10. The system of claim 9, wherein the hydraulic pump is constructed, arranged and allowed to drive the pump actuator to generate electricity in response to an increase in the second pressure at the second port of the hydraulic pump.

11. A system for stabilizing a marine vessel, comprising:

a hydraulic pump including at least a first port and a second port;

a pump actuator operably coupled to the hydraulic pump;

a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion;

a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion;

a shaft;

a first crank in rotational communication with the shaft;

a stabilizing fin mounted to a hull of the marine vessel, the stabilizing fin being in rotational communication with the shaft and the first crank; wherein:

the first port of the hydraulic pump is in hydraulic communication with at least the first chamber portion of the first hydraulic cylinder and the fourth chamber portion of the second hydraulic cylinder;

the second port of the hydraulic pump is in hydraulic communication with at least the second chamber portion of the first hydraulic cylinder and the third chamber portion of the second hydraulic cylinder;

the first rod is rotatably connected to a first portion of the first crank;

the second rod is rotatably connected to a second portion of the first crank;

the first piston moves the first rod in response to a first pressure difference between the first chamber portion and the second chamber portion;

the first rod is moved by the first piston to rotate the stabilizing fin in a first direction by rotating the first crank and the shaft;

the second piston moves the second rod in response to a second pressure difference between the third chamber portion and the fourth chamber portion; and the second rod is moved by the second piston to rotate the stabilizing fin in the first direction by rotating the first crank and the shaft.

12. The system of claim 11, wherein:

the stabilizing fin is rotated to move the first piston toward the first chamber portion of the first hydraulic cylinder by rotating the shaft and the first crank and moving the first rod, thereby increasing a first pressure at the first port of the hydraulic pump; and while the stabilizing fin is rotated to move the first piston toward the first chamber portion, the stabilizing fin is rotated to move the second piston toward the fourth chamber portion of the second hydraulic cylinder by rotating the shaft and the first crank and moving the second rod, thereby increasing the first pressure at the first port of the hydraulic pump.

13. The system of claim 12, wherein the hydraulic pump is allowed to drive the pump actuator to generate electricity in response to an increase in the first pressure at the first port of the hydraulic pump.

14. The system of claim 11, wherein:

the stabilizing fin is rotated to move the first piston toward the second chamber portion of the first hydraulic cylinder by rotating the shaft and the first crank and moving the first rod, thereby increasing a second pressure at the second port of the hydraulic pump; and while the stabilizing fin is rotated to move the first piston toward the second chamber portion, the stabilizing fin is rotated to move the second piston toward the third chamber portion of the second hydraulic cylinder by rotating the shaft and the first crank and moving the second rod, thereby increasing the second pressure at the second port of the hydraulic pump.

15. The system of claim 14, wherein the hydraulic pump is allowed to drive the pump actuator to generate electricity in response to an increase in the second pressure at the second port of the hydraulic pump.

16. A system for stabilizing a marine vessel, comprising:

a hydraulic pump including at least a first port and a second port;

a pump actuator constructed and arranged to drive the hydraulic pump;

a first hydraulic cylinder that includes a first body, a first piston positioned within the first body, a first rod connected to the first piston, a first chamber portion within the first body, and a second chamber portion within the first body, wherein the first piston is positioned between the first chamber portion and the second chamber portion;

a second hydraulic cylinder that includes a second body, a second piston positioned within the second body, a second rod connected to the second piston, a third chamber portion within the second body, and a fourth chamber portion within the second body, wherein the second piston is positioned between the third chamber portion and the fourth chamber portion;

a shaft;

a first crank in rotational communication with the shaft;

a stabilizing fin that is constructed and arranged to be mounted to a hull of the marine vessel, the stabilizing fin being in rotational communication with the shaft and the first crank; wherein:

the first port of the hydraulic pump is in fluid communication with at least the first chamber portion of the first hydraulic cylinder and the fourth chamber portion of the second hydraulic cylinder;

the second port of the hydraulic pump is in fluid communication with at least the second chamber portion of the first hydraulic cylinder and the third chamber portion of the second hydraulic cylinder;

the first rod is rotatably connected to a first portion of the first crank;

the second rod is rotatably connected to a second portion of the first crank;

the first piston is constructed and arranged to move the first rod in response to a first pressure difference between the first chamber portion and the second chamber portion;

the first rod is constructed and arranged to rotate the stabilizing fin in a first direction and in a second direction opposite the first direction by rotating the first crank and the shaft;

the second piston is constructed and arranged to move the second rod in response to a second pressure difference between the third chamber portion and the fourth chamber portion; and the second rod is constructed and arranged to rotate the stabilizing fin in the first direction and in the second direction opposite the first direction by rotating the first crank and the shaft.

17. The system of claim 16, wherein:

the stabilizing fin is constructed and arranged to rotate to move the first piston toward the first chamber portion of the first hydraulic cylinder by rotating the shaft and the first crank and moving the first rod, thereby increasing a first pressure at the first port of the hydraulic pump; and the stabilizing fin is constructed and arranged to, while moving the first piston toward the first chamber portion, rotate to move the second piston toward the fourth chamber portion of the second hydraulic cylinder by rotating the shaft and the first crank and moving the second rod, thereby increasing the first pressure at the first port of the hydraulic pump.

18. The system of claim 17, wherein the hydraulic pump is constructed, arranged and allowed to drive the pump actuator to generate electricity in response to an increase in the first pressure at the first port of the hydraulic pump.

19. The system of claim 16, wherein:

the stabilizing fin is constructed and arranged to rotate to move the first piston toward the second chamber portion of the first hydraulic cylinder by rotating the shaft and the first crank and moving the first rod, thereby increasing a second pressure at the second port of the hydraulic pump; and the stabilizing fin is constructed and arranged to, while moving the first piston toward the second chamber portion, rotate to move the second piston toward the third chamber portion of the second hydraulic cylinder by rotating the shaft and the first crank and moving the second rod, thereby increasing the second pressure at the second port of the hydraulic pump.

20. The system of claim 19, wherein the hydraulic pump is constructed, arranged and allowed to drive the pump actuator to generate electricity in response to an increase in the second pressure at the second port of the hydraulic pump.

* * * * *